US007186093B2

(12) United States Patent
Goshi

(10) Patent No.: US 7,186,093 B2
(45) Date of Patent: Mar. 6, 2007

(54) METHOD AND APPARATUS FOR COOLING MOTOR BEARINGS OF A HIGH PRESSURE PUMP

(75) Inventor: Gentaro Goshi, Phoenix, AZ (US)

(73) Assignee: Tokyo Electron Limited, Tokyo (JP)

( * ) Notice: Subject to any disclaimer, the term of this patent is extended or adjusted under 35 U.S.C. 154(b) by 227 days.

(21) Appl. No.: 10/959,483

(22) Filed: Oct. 5, 2004

(65) Prior Publication Data

US 2006/0073041 A1 Apr. 6, 2006

(51) Int. Cl.
*F04B 39/06* (2006.01)
*H02K 9/00* (2006.01)

(52) U.S. Cl. ..... 417/53; 417/228; 310/52; 310/58; 310/90

(58) Field of Classification Search ..... 417/228, 417/53; 310/52–54, 58, 90
See application file for complete search history.

(56) References Cited

U.S. PATENT DOCUMENTS 2,617,719 A 11/1952 Stewart
2,625,886 A 1/1953 Browne
2,873,597 A 2/1959 Fahringer
3,521,765 A 7/1970 Kauffman et al.
3,623,627 A 11/1971 Bolton
3,689,025 A 9/1972 Kiser
3,744,660 A 7/1973 Gaines et al.
3,968,885 A 7/1976 Hassan et al.
4,029,517 A 6/1977 Rand
4,091,643 A 5/1978 Zucchini
4,145,161 A 3/1979 Skinner
4,245,154 A 1/1981 Uehara et al.
4,341,592 A 7/1982 Shortes et al.
4,355,937 A 10/1982 Mack et al.
4,367,140 A 1/1983 Wilson
4,391,511 A 7/1983 Akiyama et al.
4,406,596 A 9/1983 Budde
4,422,651 A 12/1983 Platts
4,426,358 A 1/1984 Johansson
4,474,199 A 10/1984 Blaudszun
4,522,788 A 6/1985 Sitek et al.
4,549,467 A 10/1985 Wilden et al.
4,574,184 A 3/1986 Wolf et al.
4,592,306 A 6/1986 Gallego
4,601,181 A 7/1986 Privat
4,626,509 A 12/1986 Lyman
4,670,126 A 6/1987 Messer et al.
4,682,937 A 7/1987 Credle, Jr.
4,693,777 A 9/1987 Hazano et al.
4,749,440 A 6/1988 Blackwood et al.

(Continued)

FOREIGN PATENT DOCUMENTS

CH SE 251213 8/1948

(Continued)

OTHER PUBLICATIONS

Hideaki Itakura et al., "Multi-Chamber Dry Etching System", Solid State Technology, Apr. 1982, pp. 209-214.

(Continued)

*Primary Examiner*—Charles G. Freay
(74) *Attorney, Agent, or Firm*—Haverstock & Owens LLP

(57) ABSTRACT

A system for cooling the bearings and motor in a pump assembly used for circulating supercritical fluid is disclosed. The system uses a pressurized coolant fluid that can be substantially pure $CO_2$. The pressure difference between the circulating supercritical fluid and the coolant fluid is minimized to prevent cross-contamination of the fluids. In addition, the coolant fluid can provide a small amount of bearing lubrication.

20 Claims, 4 Drawing Sheets

U.S. PATENT DOCUMENTS

| | | | | |
|---|---|---|---|---|
| 4,778,356 | A | 10/1988 | Hicks | |
| 4,788,043 | A | 11/1988 | Kagiyama et al. | |
| 4,789,077 | A | 12/1988 | Noe | |
| 4,823,976 | A | 4/1989 | White, III et al. | |
| 4,825,808 | A | 5/1989 | Takahashi et al. | |
| 4,827,867 | A | 5/1989 | Takei et al. | |
| 4,838,476 | A | 6/1989 | Rahn | |
| 4,865,061 | A | 9/1989 | Fowler et al. | |
| 4,879,431 | A | 11/1989 | Bertoncini | |
| 4,917,556 | A | 4/1990 | Stark et al. | |
| 4,924,892 | A | 5/1990 | Kiba et al. | |
| 4,951,601 | A | 8/1990 | Maydan et al. | |
| 4,960,140 | A | 10/1990 | Ishijima et al. | |
| 4,983,223 | A | 1/1991 | Gessner | |
| 5,011,542 | A | 4/1991 | Weil | |
| 5,028,219 | A * | 7/1991 | Schuetz et al. | 417/423.4 |
| 5,044,871 | A | 9/1991 | Davis et al. | |
| 5,062,770 | A | 11/1991 | Story et al. | |
| 5,071,485 | A | 12/1991 | Matthews et al. | |
| 5,105,556 | A | 4/1992 | Kurokawa et al. | |
| 5,143,103 | A | 9/1992 | Basso et al. | |
| 5,167,716 | A | 12/1992 | Boitnott et al. | |
| 5,169,296 | A | 12/1992 | Wilden | |
| 5,169,408 | A | 12/1992 | Biggerstaff et al. | |
| 5,185,296 | A | 2/1993 | Morita et al. | |
| 5,186,594 | A | 2/1993 | Toshima et al. | |
| 5,186,718 | A | 2/1993 | Tepman et al. | |
| 5,188,515 | A | 2/1993 | Horn | |
| 5,190,373 | A | 3/1993 | Dickson et al. | |
| 5,191,993 | A | 3/1993 | Wanger et al. | |
| 5,193,560 | A | 3/1993 | Tanaka et al. | |
| 5,195,878 | A | 3/1993 | Sahiavo et al. | |
| 5,213,485 | A | 5/1993 | Wilden | |
| 5,217,043 | A | 6/1993 | Novakovi | |
| 5,221,019 | A | 6/1993 | Pechacek | |
| 5,222,876 | A | 6/1993 | Budde | |
| 5,224,504 | A | 7/1993 | Thompson et al. | |
| 5,236,669 | A | 8/1993 | Simmons et al. | |
| 5,237,824 | A | 8/1993 | Pawliszyn | |
| 5,240,390 | A | 8/1993 | Kvinge et al. | |
| 5,243,821 | A | 9/1993 | Schuck et al. | |
| 5,246,500 | A | 9/1993 | Samata et al. | |
| 5,251,776 | A | 10/1993 | Morgan, Jr. et al. | |
| 5,252,041 | A | 10/1993 | Schumack | |
| 5,259,731 | A | 11/1993 | Dhindsa et al. | |
| 5,267,455 | A | 12/1993 | Dewees et al. | |
| 5,280,693 | A | 1/1994 | Heudecker | |
| 5,285,352 | A | 2/1994 | Pastore et al. | |
| 5,288,333 | A | 2/1994 | Tanaka et al. | |
| 5,306,350 | A | 4/1994 | Hoy et al. | |
| 5,313,965 | A | 5/1994 | Palen | |
| 5,314,574 | A | 5/1994 | Takahashi | |
| 5,328,722 | A | 7/1994 | Ghanayem et al. | |
| 5,337,446 | A | 8/1994 | Smith et al. | |
| 5,339,844 | A | 8/1994 | Stanford, Jr. et al. | |
| 5,355,901 | A | 10/1994 | Mielnik et al. | |
| 5,368,171 | A | 11/1994 | Jackson | |
| 5,370,741 | A | 12/1994 | Bergman | |
| 5,374,829 | A | 12/1994 | Sakamoto et al. | |
| 5,377,705 | A | 1/1995 | Smith, Jr. et al. | |
| 5,401,322 | A | 3/1995 | Marshall | |
| 5,404,894 | A | 4/1995 | Shiraiwa | |
| 5,412,958 | A | 5/1995 | Iliff et al. | |
| 5,417,768 | A | 5/1995 | Smith, Jr. et al. | |
| 5,433,334 | A | 7/1995 | Reneau | |
| 5,447,294 | A | 9/1995 | Sakata et al. | |
| 5,474,410 | A | 12/1995 | Ozawa et al. | |
| 5,494,526 | A | 2/1996 | Paranjpe | |
| 5,503,176 | A | 4/1996 | Dunmire et al. | |
| 5,505,219 | A | 4/1996 | Lansberry et al. | |
| 5,509,431 | A | 4/1996 | Smith, Jr. et al. | |
| 5,526,834 | A | 6/1996 | Mielnik et al. | |
| 5,533,538 | A | 7/1996 | Marshall | |
| 5,540,554 | A | 7/1996 | Masuzawa | |
| 5,571,330 | A | 11/1996 | Kyogoku | |
| 5,589,224 | A | 12/1996 | Tepman et al. | |
| 5,621,982 | A | 4/1997 | Yamashita et al. | |
| 5,629,918 | A | 5/1997 | Ho et al. | |
| 5,644,855 | A | 7/1997 | McDermott et al. | |
| 5,649,809 | A | 7/1997 | Stapelfeldt | |
| 5,656,097 | A | 8/1997 | Olesen et al. | |
| 5,669,251 | A | 9/1997 | Townsend et al. | |
| 5,672,204 | A | 9/1997 | Habuka | |
| 5,679,169 | A | 10/1997 | Gonzales et al. | |
| 5,702,228 | A | 12/1997 | Tamai et al. | |
| 5,706,319 | A | 1/1998 | Holtz | |
| 5,746,008 | A | 5/1998 | Yamashita et al. | |
| 5,769,588 | A | 6/1998 | Toshima et al. | |
| 5,772,783 | A | 6/1998 | Stucker | |
| 5,797,719 | A | 8/1998 | James et al. | |
| 5,798,126 | A | 8/1998 | Fijikawa et al. | |
| 5,817,178 | A | 10/1998 | Mita et al. | |
| 5,850,747 | A | 12/1998 | Roberts et al. | |
| 5,858,107 | A | 1/1999 | Chao et al. | |
| 5,865,602 | A | 2/1999 | Nozari | |
| 5,879,459 | A | 3/1999 | Gadgil et al. | |
| 5,881,577 | A | 3/1999 | Sauer et al. | |
| 5,882,165 | A | 3/1999 | Maydan et al. | |
| 5,882,182 | A * | 3/1999 | Kato et al. | 417/366 |
| 5,888,050 | A | 3/1999 | Fitzgerald et al. | |
| 5,898,727 | A | 4/1999 | Fujikawa et al. | |
| 5,900,107 | A | 5/1999 | Murphy et al. | |
| 5,904,737 | A | 5/1999 | Preston et al. | |
| 5,906,866 | A | 5/1999 | Webb | |
| 5,928,389 | A | 7/1999 | Jevtic | |
| 5,932,100 | A | 8/1999 | Yager et al. | |
| 5,934,856 | A | 8/1999 | Asakawa et al. | |
| 5,934,991 | A | 8/1999 | Rush | |
| 5,943,721 | A | 8/1999 | Lerette et al. | |
| 5,946,945 | A | 9/1999 | Kegler et al. | |
| 5,970,554 | A | 10/1999 | Shore et al. | |
| 5,971,714 | A | 10/1999 | Schaffer et al. | |
| 5,975,492 | A | 11/1999 | Brenes | |
| 5,979,306 | A | 11/1999 | Fujikawa et al. | |
| 5,980,648 | A | 11/1999 | Adler | |
| 5,981,399 | A | 11/1999 | Kawamura et al. | |
| 5,989,342 | A | 11/1999 | Ikeda et al. | |
| 6,005,226 | A | 12/1999 | Aschner et al. | |
| 6,010,315 | A * | 1/2000 | Kishimoto et al. | 417/228 |
| 6,017,820 | A | 1/2000 | Ting et al. | |
| 6,021,791 | A | 2/2000 | Dryer et al. | |
| 6,029,371 | A | 2/2000 | Kamikawa et al. | |
| 6,041,817 | A | 3/2000 | Guertin | |
| 6,045,331 | A | 4/2000 | Gehm et al. | |
| 6,070,440 | A | 6/2000 | Malchow et al. | |
| 6,109,296 | A | 8/2000 | Austin | |
| 6,123,510 | A | 9/2000 | Greer et al. | |
| 6,190,459 | B1 | 2/2001 | Takeshita et al. | 118/715 |
| 6,228,563 | B1 | 5/2001 | Starov et al. | |
| 6,235,634 | B1 | 5/2001 | White et al. | |
| 6,239,038 | B1 | 5/2001 | Wen | |
| 6,241,825 | B1 | 6/2001 | Wytman | |
| 6,244,121 | B1 | 6/2001 | Hunter | |
| 6,251,250 | B1 | 6/2001 | Keigler | |
| 6,264,003 | B1 * | 7/2001 | Dong et al. | 184/104.1 |
| 6,264,752 | B1 | 7/2001 | Curtis et al. | |
| 6,264,753 | B1 | 7/2001 | Chao et al. | |
| 6,277,753 | B1 | 8/2001 | Mullee et al. | |
| 6,286,231 | B1 | 9/2001 | Bergman et al. | |
| 6,305,677 | B1 | 10/2001 | Lenz | |
| 6,333,268 | B1 | 12/2001 | Starov et al. | |
| 6,334,266 | B1 | 1/2002 | Moritz et al. | |
| 6,344,174 | B1 | 2/2002 | Miller et al. | |
| 6,521,466 | B1 | 2/2002 | Castrucci | |

| | | | |
|---|---|---|---|
| 6,355,072 | B1 | 3/2002 | Racette et al. |
| 6,363,292 | B1 | 3/2002 | McLoughlin |
| 6,388,317 | B1 | 5/2002 | Reese |
| 6,389,677 | B1 | 5/2002 | Lenz |
| 6,406,782 | B2 | 6/2002 | Johnson et al. |
| 6,418,956 | B1 | 7/2002 | Bloom |
| 6,436,824 | B1 | 8/2002 | Chooi et al. |
| 6,454,519 | B1 | 9/2002 | Toshima et al. |
| 6,454,945 | B1 | 9/2002 | Weigl et al. |
| 6,464,790 | B1 | 10/2002 | Shertinsky et al. |
| 6,465,403 | B1 | 10/2002 | Skee |
| 6,508,259 | B1 | 1/2003 | Tseronis et al. |
| 6,509,141 | B2 | 1/2003 | Mullee |
| 6,541,278 | B2 | 4/2003 | Morita et al. |
| 6,546,946 | B2 | 4/2003 | Dunmire |
| 6,550,484 | B1 | 4/2003 | Gopinath et al. |
| 6,558,475 | B1 | 5/2003 | Jur et al. |
| 6,561,213 | B2 | 5/2003 | Wang et al. |
| 6,561,220 | B2 | 5/2003 | McCullough et al. |
| 6,561,481 | B1 | 5/2003 | Filonczuk |
| 6,561,797 | B1 | 5/2003 | Biberger et al. |
| 6,564,826 | B2 | 5/2003 | Shen |
| 6,596,093 | B2 | 7/2003 | DeYoung et al. |
| 6,612,317 | B2 | 9/2003 | Costantini et al. |
| 6,616,414 | B2 | 9/2003 | Yoo et al. |
| 6,635,565 | B2 | 10/2003 | Wu et al. |
| 6,641,678 | B2 | 11/2003 | DeYoung et al. |
| 6,722,642 | B1 | 4/2004 | Sutton et al. |
| 6,736,149 | B2 | 5/2004 | Biberger et al. |
| 6,764,212 | B1 | 7/2004 | Nitta et al. ..... 366/114 |
| 6,764,552 | B1 | 7/2004 | Joyce et al. |
| 6,805,801 | B1 | 10/2004 | Humayun et al. |
| 6,815,922 | B2 | 11/2004 | Yoo et al. |
| 6,851,148 | B2 | 2/2005 | Preston et al. |
| 6,874,513 | B2 | 4/2005 | Yamagata et al. |
| 6,921,456 | B2 | 7/2005 | Biberger et al. |
| 6,966,967 | B2 | 11/2005 | Curry et al. |
| 2001/0050096 | A1 | 12/2001 | Costantini et al. |
| 2002/0001929 | A1 | 1/2002 | Biberger et al. |
| 2002/0046707 | A1 | 4/2002 | Biberger et al. |
| 2002/0189543 | A1 | 12/2002 | Biberger et al. |
| 2003/0036023 | A1 | 2/2003 | Moreau et al. |
| 2003/0051741 | A1 | 3/2003 | DeSimone et al. |
| 2003/0161734 | A1 | 8/2003 | Kim |
| 2003/0196679 | A1 | 10/2003 | Cotte et al. |
| 2003/0205510 | A1 | 11/2003 | Jackson |
| 2004/0020518 | A1 | 2/2004 | DeYoung et al. |
| 2004/0134515 | A1 | 7/2004 | Castrucci |
| 2004/0157463 | A1 | 8/2004 | Jones |
| 2004/0213676 | A1 | 10/2004 | Phillips et al. |
| 2005/0014370 | A1 | 1/2005 | Jones |
| 2005/0026547 | A1 | 2/2005 | Moore et al. |
| 2005/0111987 | A1 | 5/2005 | Yoo et al. |
| 2005/0141998 | A1 | 6/2005 | Yoo et al. |
| 2005/0158178 | A1 | 7/2005 | Yoo et al. |
| 2005/0191184 | A1 | 9/2005 | Vinson, Jr. |
| 2006/0130966 | A1 | 6/2006 | Babic et al. |

FOREIGN PATENT DOCUMENTS

| | | | |
|---|---|---|---|
| CN | 1399790 | A | 2/2003 |
| DE | 36 08 783 | A1 | 9/1987 |
| DE | 198 60 084 | A1 | 7/2000 |
| EP | 0 244 951 | A2 | 11/1987 |
| EP | 0 272 141 | A2 | 6/1988 |
| EP | 0 453 867 | A1 | 10/1991 |
| EP | 0 572 913 | A1 | 12/1993 |
| EP | 0 587 168 | A1 | 3/1994 |
| EP | 0 679 753 | B1 | 11/1995 |
| EP | 0 726 099 | A2 | 8/1996 |
| EP | 0 743 379 | A1 | 11/1996 |
| EP | 0 903 775 | A2 | 3/1999 |
| FR | 1.499.491 | | 9/1967 |
| GB | 2 003 975 | | 3/1979 |
| GB | 2 193 482 | | 2/1988 |
| JP | 56-142629 | | 11/1981 |
| JP | 60-238479 | | 11/1985 |
| JP | 60-246635 | | 12/1985 |
| JP | 61-017151 | | 1/1986 |
| JP | 61-231166 | | 10/1986 |
| JP | 62-111442 | | 5/1987 |
| JP | 62-125619 | | 6/1987 |
| JP | 2001/106358 | | 4/1988 |
| JP | 63-179530 | | 7/1988 |
| JP | 63-256326 | | 10/1988 |
| JP | 63-303059 | | 12/1988 |
| JP | 2-148841 | | 6/1990 |
| JP | 2-209729 | | 8/1990 |
| JP | 4-17333 | | 1/1992 |
| JP | 4-284648 | | 10/1992 |
| JP | 7-283104 | | 10/1995 |
| JP | 8-186140 | | 7/1996 |
| JP | 8-252549 | | 10/1996 |
| JP | 9-43857 | | 2/1997 |
| JP | 10-144757 | | 5/1998 |
| JP | 10-260537 | | 9/1998 |
| JP | 10-335408 | | 12/1998 |
| JP | 11-200035 | | 7/1999 |
| JP | 11-274132 | | 10/1999 |
| WO | WO 87/07309 | | 12/1987 |
| WO | WO 91/12629 | | 8/1991 |
| WO | WO 99/18603 | | 4/1999 |
| WO | WO 00/36635 | | 6/2000 |
| WO | WO 01/10733 | A1 | 2/2001 |
| WO | WO 01/22016 | A1 | 3/2001 |
| WO | WO 01/33615 | A3 | 5/2001 |
| WO | WO 01/55628 | A1 | 8/2001 |
| WO | WO 01/68279 | A2 | 9/2001 |
| WO | WO 01/74538 | A1 | 10/2001 |
| WO | WO 01/78911 | A1 | 10/2001 |
| WO | WO 01/85391 | A2 | 11/2001 |
| WO | WO 01/94782 | A3 | 12/2001 |
| WO | WO 02/09147 | A2 | 1/2002 |
| WO | WO 02/16051 | A2 | 2/2002 |
| WO | WO 03/030219 | A2 | 10/2003 |

OTHER PUBLICATIONS

Sun, Y.P. et al., "Preparation of Polymer-Protected Semiconductor Nanoparticles Through the Rapid Expansion of Supercritical Fluid Solution," Chemical Physics Letters, pp. 585-588, May 22, 1998.

Dahmen, N. et al., "Supercritical Fluid Extraction of Grinding and Metal Cutting Waste Contaminated with Oils," Supercritical Fluids—Extraction and Pollution Prevention, ACS Symposium Series, vol. 670, pp. 270-279, Oct. 21, 1997.

Xu, C. et al., "Submicron-Sized Spherical Yttrium Oxide Based Phosphors Prepared by Supercritical CO2-Assisted aerosolization and pyrolysis," Appl. Phys. Lett, vol. 71, No. 12, Sep. 22, 1997, pp. 1643-1645.

Courtecuisse, V.G. et al., "Kinetics of the Titanium Isopropoxide Decomposition in Supercritical Isopropyl Alcohol," Ind. Eng. Chem. Res., vol. 35, No. 8, pp. 2539-2545, Aug. 1996.

Gallagher-Wetmore, P. et al., "Supercritical Fluid Processing: A New Dry Technique for Photoresist Developing," SPIE vol. 2438, pp. 694-708, Jun. 1995.

McHardy, J. et al., "Progress in Supercritical CO2 Cleaning," SAMPE Jour., vol. 29, No. 5, pp. 20-27, Sep. 1993.

Purtell, R, et al., "Precision Parts Cleaning using Supercritical Fluids," J. Vac, Sci, Technol. A. vol. 11, No. 4, Jul. 1993, pp. 1696-1701.

Hansen, B.N. et al., "Supercritical Fluid Transport—Chemical Deposition of Films,"Chem. Mater., vol. 4, No. 4, pp. 749-752, 1992.

Hybertson, B.M. et al., "Deposition of Palladium Films by a Novel Supercritical Fluid Transport Chemical Deposition Process," Mat. Res. Bull., vol. 26, pp. 1127-1133, 1991.
Ziger, D. H. et al., "Compressed Fluid Technology: Application to RIE-Developed Resists," AiChE Jour., vol. 33, No. 10, pp. 1585-1591, Oct. 1987.
Matson, D.W. et al., "Rapid Expansion of Supercritical Fluid Solutions: Solute Formation of Powders, Thin Films, and Fibers," Ind. Eng. Chem. Res., vol. 26, No. 11, pp. 2298-2306, 1987.
Tolley, W.K. et al., "Stripping Organics from Metal and Mineral Surfaces using Supercritical Fluids," Separation Science and Technology, vol. 22, pp. 1087-1101, 1987.
Joseph L. Foszcz, "Diaphragm Pumps Eliminate Seal Problems", Plant Engineering , pp. 1-5, Feb. 1, 1996.
Bob Agnew, "WILDEN Air-Operated Diaphragm Pumps", Process & Industrial Training Technologies, Inc., 1996.

* cited by examiner

100

METHOD AND APPARATUS FOR COOLING MOTOR BEARINGS OF A HIGH PRESSURE PUMP

CROSS-REFERENCE TO RELATED APPLICATIONS

This patent application is related to commonly owned co-pending U.S. patent application Ser. No. 10/718,964, filed Nov. 21, 2003, entitled "PUMP DESIGN FOR CIRCULATING SUPERCRITICAL CARBON DIOXIDE" which is hereby incorporated by reference in its entirety.

FIELD OF THE INVENTION

This invention relates to an improved pump assembly design for circulating supercritical fluids. More particularly, the invention relates to a system and method for cooling and/or lubricating the bearings of a supercritical fluid pump.

BACKGROUND OF THE INVENTION

Traditional brushless canned motor pumps have a pump section and a motor section. The motor section drives the pump section. The pump section includes an impeller having blades that rotate inside a casing. The impeller pumps fluid from a pump inlet to a pump outlet. The impeller is normally of the closed type and is coupled to one end of a motor shaft that extends from the motor section into the pump section where it affixes to an end of the impeller.

The motor section includes an electric motor having a stator and a rotor. The rotor is unitarily formed with the motor shaft inside the stator. With brushless DC motors, the rotor is actuated by electromagnetic fields that are generated by current flowing through windings of the stator. A plurality of magnets is coupled to the rotor. During pump operation, the rotor shaft transmits torque, which is created by the generation of the electromagnetic fields with regard to the rotor's magnets, from the motor section to the pump section where the fluid is pumped.

Because the rotor and stator are immersed, they must be isolated to prevent corrosive attack and electrical failure. The rotor is submerged in the fluid being pumped and is therefore "canned" or sealed to isolate the motor parts from contact with the fluid. The stator is also "canned" or sealed to isolate it from the fluid being pumped. Mechanical contact bearings may be submerged in system fluid and are, therefore, continually lubricated. The bearings support the impeller and/or the motor shaft. A portion of the pumped fluid can be allowed to recirculate through the motor section to cool the motor parts and lubricate the bearings.

Seals and bearings are prone to failure due to continuous mechanical wear during operation of the pump. Mechanical rub between the stator and the rotor can generate particles. Interacting forces between the rotor and the stator in fluid seals and hydrodynamic behavior of journal bearings can lead to self-excited vibrations that may ultimately damage or even destroy rotating machinery. The bearings are also prone to failure. Lubricants can be rendered ineffective due to particulate contamination of the lubricant, which could adversely affect pump operation. Lubricants can also dissolve in the fluid being pumped and contaminate the fluid. Bearings operating in a contaminated lubricant exhibit a higher initial rate of wear than those not running in a contaminated lubricant. The bearings and the seals may be particularly susceptible to failure when in contact with certain chemistry. Alternatively, the bearings may damage the fluid being pumped.

What is needed is an improved brushless compact canned pump assembly design that substantially reduces particle generation and contamination, while rotating at high speeds and operating at supercritical temperatures and pressures.

SUMMARY OF THE INVENTION

In accordance with an embodiment of the present invention, a pump assembly for circulating a supercritical fluid is disclosed. The pump assembly for circulating a supercritical fluid can include an impeller for pumping supercritical process fluid between a pump inlet and a pump outlet; a rotatable pump shaft coupled to the impeller; a motor coupled to the rotatable pump shaft; a plurality of bearings coupled to the rotatable pump shaft; a plurality of flow passages coupled to the plurality of bearings; an injection means for delivering pressurized cooling fluid to the plurality of flow passages; a regulator, coupled to the injection means, for controlling the pressure of the pressurized cooling fluid; and a coolant outlet for venting the pressurized cooling fluid from the pump assembly.

Another embodiment discloses a system for cooling pump bearings in a pump assembly for circulating a supercritical fluid, and the system can include means for monitoring a temperature of a motor in the pump assembly that includes a pump and a motor connected by a rotatable pump shaft, and an impeller for pumping supercritical fluid between a pump inlet and a pump outlet; means for flowing a pressurized coolant fluid through the pump assembly until the temperature of the motor is stabilized, and the pressurized coolant fluid flows from a coolant inlet through a plurality of coolant passages to a coolant outlet; means for pumping supercritical process fluid from a pump inlet to a pump outlet; means for monitoring a pressure of the supercritical process fluid at the pump outlet; means for monitoring a pressure of the pressurized coolant fluid at the coolant outlet; and means for regulating the flow of the pressurized coolant fluid through the pump assembly based on a difference between the pressure of the supercritical process fluid at the pump outlet and the pressure of the pressurized coolant fluid at the coolant outlet, and the coolant fluid can include substantially pure $CO_2$.

Another embodiment discloses a method of cooling pump bearings in a pump assembly for circulating a supercritical fluid, and the method can include: monitoring a temperature of a motor in the pump assembly, where the pump assembly comprises a pump and a motor connected by a rotatable pump shaft, and further wherein the pump has an impeller for pumping supercritical fluid between a pump inlet and a pump outlet; flowing a pressurized coolant fluid through the pump assembly until the temperature of the motor is stabilized, where the pressurized coolant fluid flows from a coolant inlet through a plurality of coolant passages to a coolant outlet; pumping supercritical process fluid from a pump inlet to a pump outlet; monitoring a pressure of the supercritical process fluid at the pump outlet; monitoring a pressure of the pressurized coolant fluid at the coolant outlet; and regulating the flow of the pressurized coolant fluid through the pump assembly based on a difference between the pressure of the supercritical process fluid at the pump outlet and the pressure of the pressurized coolant fluid at the coolant outlet, and the coolant fluid can include substantially pure $CO_2$.

BRIEF DESCRIPTION OF THE DRAWINGS

A more complete appreciation of various embodiments of the invention and many of the attendant advantages thereof will become readily apparent with reference to the following detailed description, particularly when considered in conjunction with the accompanying drawings, in which.

DETAILED DESCRIPTION OF SEVERAL EMBODIMENTS

Figure 1:
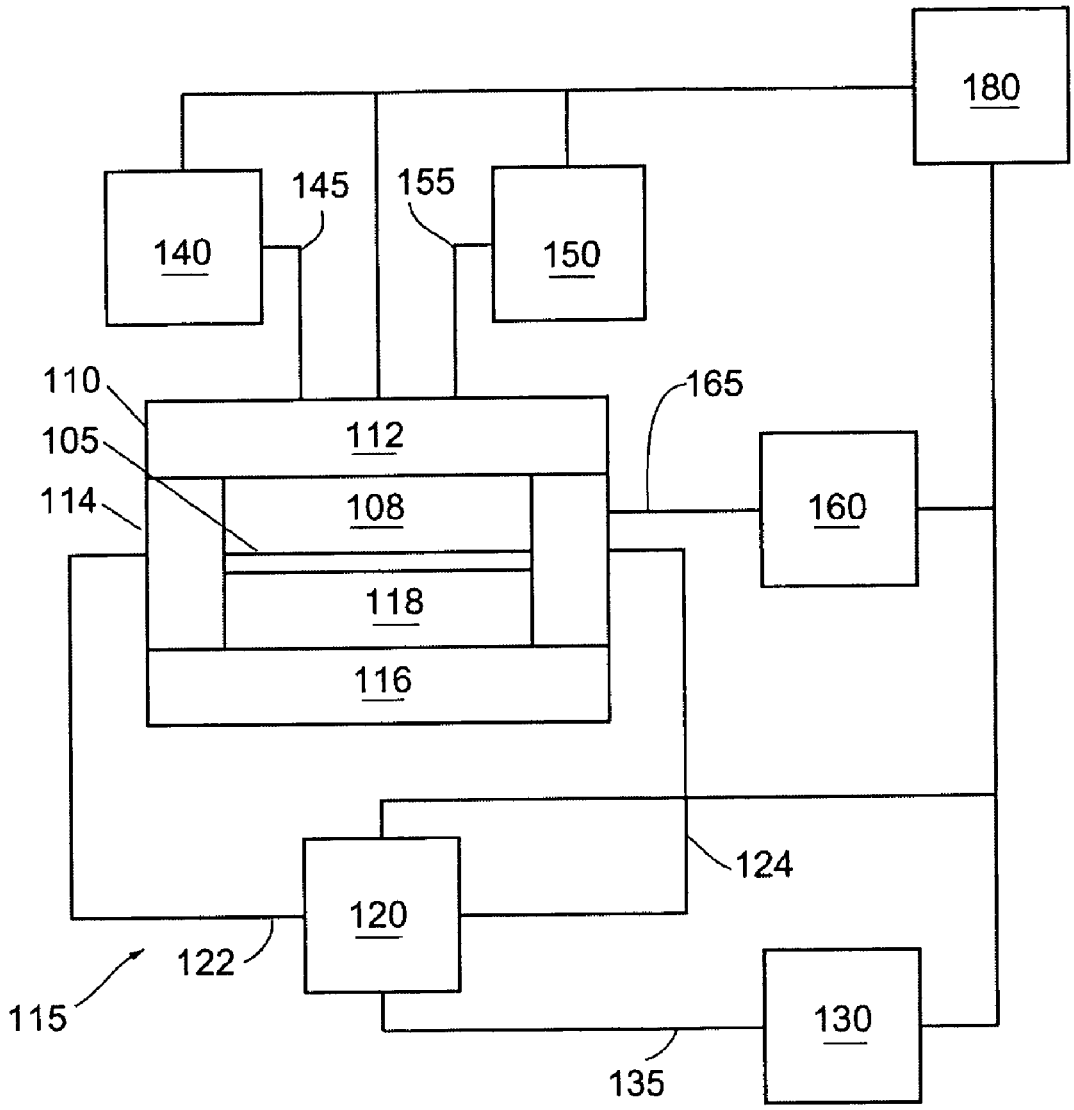
FIG. 1 shows an exemplary block diagram of a processing system in accordance with an embodiment of the present invention.

FIG. 1 shows an exemplary block diagram of a processing system in accordance with an embodiment of the invention. In the illustrated embodiment, processing system 100 comprises a processing module 110, a recirculation system 120, a process chemistry supply system 130, a carbon dioxide supply system 140, a pressure control system 150, an exhaust system 160, and a controller 180. The processing system 100 can operate at pressures that can range from 1000 psi. to 10,000 psi. In addition, the processing system 100 can operate at temperatures that can range from 40 to 300 degrees Celsius.

The controller 180 can be coupled to the processing module 110, the recirculation system 120, the process chemistry supply system 130, the carbon dioxide supply system 140, the pressure control system 150, and the exhaust system 160. Alternately, controller 180 can be coupled to one or more additional controllers/computers (not shown), and controller 180 can obtain setup and/or configuration information from an additional controller/computer.

In FIG. 1, singular processing elements (110, 120, 130, 140, 150, 160, and 180) are shown, but this is not required for the invention. The semiconductor processing system 100 can comprise any number of processing elements having any number of controllers associated with them in addition to independent processing elements.

The controller 180 can be used to configure any number of processing elements (110, 120, 130, 140, 150, and 160), and the controller 180 can collect, provide, process, store, and display data from processing elements. The controller 180 can comprise a number of applications for controlling one or more of the processing elements. For example, controller 180 can include a GUI component (not shown) that can provide easy to use interfaces that enable a user to monitor and/or control one or more processing elements.

The processing module 110 can include an upper assembly 112, a frame 114, and a lower assembly 116. The upper assembly 112 can comprise a heater (not shown) for heating the process chamber, the substrate, or the processing fluid, or a combination of two or more thereof. Alternately, a heater is not required. The frame 114 can include means for flowing a processing fluid through the processing chamber 108. In one example, a circular flow pattern can be established, and in another example, a substantially linear flow pattern can be established. Alternately, the means for flowing can be configured differently. The lower assembly 116 can comprise one or more lifters (not shown) for moving the chuck 118 and/or the substrate 105. Alternately, a lifter is not required.

In one embodiment, the processing module 110 can include a holder or chuck 118 for supporting and holding the substrate 105 while processing the substrate 105. The stage or chuck 118 can also be configured to heat or cool the substrate 105 before, during, and/or after processing the substrate 105. Alternately, the processing module 110 can include a platen (not shown) for supporting and holding the substrate 105 while processing the substrate 105.

A transfer system (not shown) can be used to move a substrate into and out of the processing chamber 108 through a slot (not shown). In one example, the slot can be opened and closed by moving the chuck, and in another example, the slot can be controlled using a gate valve.

The substrate can include semiconductor material, metallic material, dielectric material, ceramic material, or polymer material, or a combination of two or more thereof. The semiconductor material can include Si, Ge, Si/Ge, or GaAs. The metallic material can include Cu, Al, Ni, Pb, Ti, Ta, or W, or combinations of two or more thereof. The dielectric material can include Si, O, N, or C, or combinations of two or more thereof. The ceramic material can include Al, N, Si, C, or O, or combinations of two or more thereof.

The recirculation system can be coupled to the process module 110 using one or more inlet lines 122 and one or more outlet lines 124. The recirculation system 120 can comprise one or more valves for regulating the flow of a supercritical processing solution through the recirculation system and through the processing module 110. The recirculation system 120 can comprise any number of back-flow valves, filters, pumps, and/or heaters (not shown) for maintaining a supercritical processing solution and flowing the supercritical process solution through the recirculation system 120 and through the processing chamber 108 in the processing module 110.

Processing system 100 can comprise a chemistry supply system 130. In the illustrated embodiment, the chemistry supply system is coupled to the recirculation system 120 using one or more lines 135, but this is not required for the invention. In alternate embodiments, the chemical supply system can be configured differently and can be coupled to different elements in the processing system. For example, the chemistry supply system 130 can be coupled to the process module 110.

The chemistry supply system 130 can comprise a cleaning chemistry assembly (not shown) for providing cleaning chemistry for generating supercritical cleaning solutions within the processing chamber. The cleaning chemistry can include peroxides and a fluoride source. Further details of fluoride sources and methods of generating supercritical processing solutions with fluoride sources are described in U.S. patent application Ser. No. 10/442,557, filed on May 10, 2003, and titled "TETRA-ORGANIC AMMONIUM FLUORIDE AND HF IN SUPERCRITICAL FLUID FOR PHOTORESIST AND RESIDUE REMOVAL", and U.S. patent application Ser. No. 10/321,341, filed on Dec. 10, 2003, and titled "FLUORIDE IN SUPERCRITICAL FLUID FOR PHOTORESIST POLYMER AND RESIDUE REMOVAL," both incorporated by reference herein.

In addition, the cleaning chemistry can include chelating agents, complexing agents, oxidants, organic acids, and inorganic acids that can be introduced into supercritical carbon dioxide with one or more carrier solvents, such as N,N-dimethylacetamide (DMAc), gamma-butyrolactone (BLO), dimethyl sulfoxide (DMSO), ethylene carbonate (EC), N-methylpyrrolidone (NMP), dimethylpiperidone, propylene carbonate, and alcohols (such a methanol, ethanol and 1-propanol).

The chemistry supply system 130 can comprise a rinsing chemistry assembly (not shown) for providing rinsing chemistry for generating supercritical rinsing solutions within the processing chamber. The rinsing chemistry can include one or more organic solvents including, but not limited to, alcohols and ketones. In one embodiment, the rinsing chemistry can comprise sulfolane, also known as thiocyclopenatne-1,1-dioxide, (Cyclo) tetramethylene sulphone and 1,3,4,5-tetrahydrothiophene-1,1-dioxide, which can be purchased from a number of venders, such as Degussa Stanlow Limited, Lake Court, Hursley Winchester SO21 1LD UK.

The chemistry supply system 130 can comprise a curing chemistry assembly (not shown) for providing curing chemistry for generating supercritical curing solutions within the processing chamber.

The processing system 100 can comprise a carbon dioxide supply system 140. As shown in FIG. 1, the carbon dioxide supply system 140 can be coupled to the processing module 110 using one or more lines 145, but this is not required. In alternate embodiments, carbon dioxide supply system 140 can be configured differently and coupled differently. For example, the carbon dioxide supply system 140 can be coupled to the recirculation system 120.

The carbon dioxide supply system 140 can comprise a carbon dioxide source (not shown) and a plurality of flow control elements (not shown) for generating a supercritical fluid. For example, the carbon dioxide source can include a $CO_2$ feed system, and the flow control elements can include supply lines, valves, filters, pumps, and heaters. The carbon dioxide supply system 140 can comprise an inlet valve (not shown) that is configured to open and close to allow or prevent the stream of supercritical carbon dioxide from flowing into the processing chamber 108. For example, controller 180 can be used to determine fluid parameters such as pressure, temperature, process time, and flow rate.

The processing system 100 can also comprise a pressure control system 150. As shown in FIG. 1, the pressure control system 150 can be coupled to the processing module 110 using one or more lines 155, but this is not required. In alternate embodiments, pressure control system 150 can be configured differently and coupled differently. The pressure control system 150 can include one or more pressure valves (not shown) for exhausting the processing chamber 108 and/or for regulating the pressure within the processing chamber 108. Alternately, the pressure control system 150 can also include one or more pumps (not shown). For example, one pump may be used to increase the pressure within the processing chamber, and another pump may be used to evacuate the processing chamber 108. In another embodiment, the pressure control system 150 can comprise means for sealing the processing chamber. In addition, the pressure control system 150 can comprise means for raising and lowering the substrate and/or the chuck.

Furthermore, the processing system 100 can comprise an exhaust control system 160. As shown in FIG. 1, the exhaust control system 160 can be coupled to the processing module 110 using one or more lines 165, but this is not required. In alternate embodiments, exhaust control system 160 can be configured differently and coupled differently. The exhaust control system 160 can include an exhaust gas collection vessel (not shown) and can be used to remove contaminants from the processing fluid. Alternately, the exhaust control system 160 can be used to recycle the processing fluid.

Controller 180 can use pre-process data, process data, and post-process data. For example, pre-process data can be associated with an incoming substrate. This pre-process data can include lot data, batch data, run data, composition data, and history data. The pre-process data can be used to establish an input state for a wafer. Process data can include process parameters. Post processing data can be associated with a processed substrate.

The controller 180 can use the pre-process data to predict, select, or calculate a set of process parameters to use to process the substrate. For example, this predicted set of process parameters can be a first estimate of a process recipe. A process model can provide the relationship between one or more process recipe parameters or set points and one or more process results. A process recipe can include a multi-step process involving a set of process modules. Post-process data can be obtained at some point after the substrate has been processed. For example, post-process data can be obtained after a time delay that can vary from minutes to days. The controller can compute a predicted state for the substrate based on the pre-process data, the process characteristics, and a process model. For example, a cleaning rate model can be used along with a contaminant level to compute a predicted cleaning time. Alternately, a rinse rate model can be used along with a contaminant level to compute a processing time for a rinse process.

It will be appreciated that the controller 180 can perform other functions in addition to those discussed here. The controller 180 can monitor the pressure, temperature, flow, or other variables associated with the processing system 100 and take actions based on these values. For example, the controller 180 can process measured data, display data and/or results on a GUI screen, determine a fault condition, determine a response to a fault condition, and alert an operator. The controller 180 can comprise a database component (not shown) for storing input and output data.

In a supercritical cleaning/rinsing process, the desired process result can be a process result that is measurable using an optical measuring device. For example, the desired process result can be an amount of contaminant in a via or on the surface of a substrate. After each cleaning process run, the desired process result can be measured.

Figure 2:
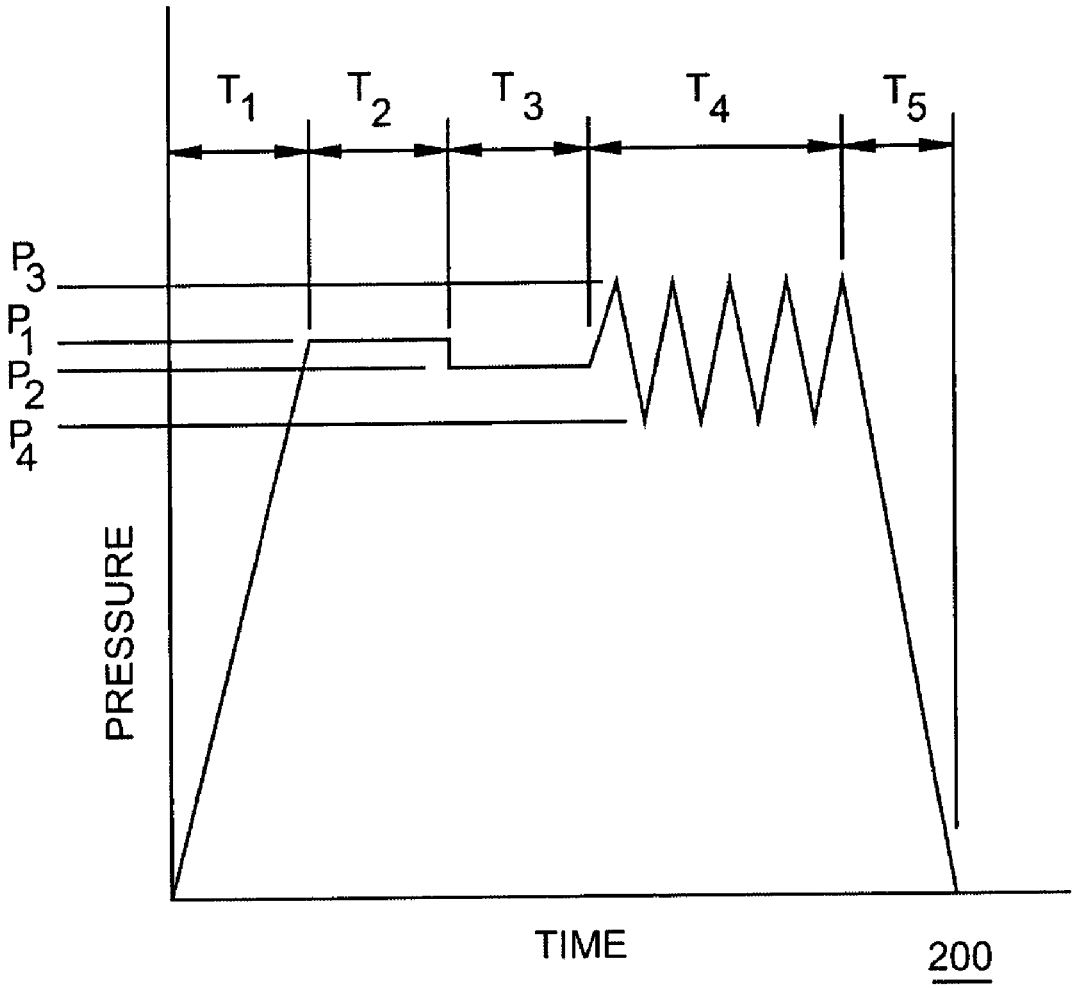
FIG. 2 is a plot of pressure versus time for a supercritical cleaning, rinse or curing processing step, in accordance with an embodiment of the invention.

FIG. 2 illustrates an exemplary graph of pressure versus time for a supercritical process step in accordance with an embodiment of the invention. In the illustrated embodiment, a graph 200 is shown for a supercritical cleaning process step or a supercritical rinse process step. Alternately, different pressures, different timing, and different sequences may be used for different processes.

Now referring to both FIGS. 1 and 2, prior to an initial time $T_0$, the substrate with post-etch residue thereon can be placed within the processing chamber 108 and the processing chamber 108 can be sealed. The substrate and the processing chamber can be heated to an operational temperature. For example, the operational temperature can range from 40 to 300 degrees Celsius.

From the initial time $T_0$ through a first duration of time $T_1$, the processing chamber 108 is pressurized. In one embodiment, when the processing chamber 108 exceeds a critical pressure Pc (1,070 psi), process chemistry can be injected into the processing chamber 108, using the process chemistry supply system 130. In alternate embodiments, process chemistry may be injected into the processing chamber 108 before the pressure exceeds the critical pressure Pc (1,070 psi) using the process chemistry supply system 130. For example, the injection(s) of the process chemistries can begin upon reaching about 1100–1200 psi. In other embodiments, process chemistry is not injected during the $T_1$ period.

In one embodiment, process chemistry is injected in a linear fashion. In other embodiments, process chemistry may be injected in a non-linear fashion. For example, process chemistry can be injected in one or more steps.

The process chemistry preferably includes a pyridine-HF adduct species that is injected into the system. One or more injections of process chemistries can be performed over the duration of time $T_1$ to generate a supercritical processing solution with the desired concentrations of chemicals. The process chemistry, in accordance with the embodiments of the invention, can also include one more or more carrier solvents, ammonium salts, hydrogen fluoride, and/or other sources of fluoride.

During a second time $T_2$, the supercritical processing solution can be re-circulated over the substrate and through the processing chamber 108 using the recirculation system 120, such as described above. In one embodiment, process chemistry is not injected during the second time $T_2$. Alternatively, process chemistry may be injected into the processing chamber 108 during the second time $T_2$ or after the second time $T_2$. The processing chamber 108 can operate at a pressure above 1,500 psi during the second time $T_2$. For example, the pressure can range from approximately 2,500 psi to approximately 3,100 psi, but can be any value so long as the operating pressure is sufficient to maintain supercritical conditions. The supercritical processing solution is circulated over the substrate and through the processing chamber 108 using the recirculation system 120, such as described above. Then the pressure within the processing chamber 108 is increased and over the duration of time, the supercritical processing solution continues to be circulated over the substrate and through the processing chamber 108 using the recirculation system 120 and or the concentration of the supercritical processing solution within the processing chamber is adjusted by a push-through process, as described below.

Still referring to both FIGS. 1 and 2, during a third time $T_3$ a push-through process can be performed. During the third time $T_3$, a new quantity of supercritical carbon dioxide can be fed into the processing chamber 108 from the carbon dioxide supply system 140, and the supercritical cleaning solution along with process residue suspended or dissolved therein can be displaced from the processing chamber 108 through the exhaust control system 160. In addition, supercritical carbon dioxide can be fed into the recirculation system 120 from the carbon dioxide supply system 140, and the supercritical cleaning solution along with process residue suspended or dissolved therein can also be displaced from the recirculation system 120 through the exhaust control system 160.

After the push-through process is complete, a decompression process can be performed. In an alternate embodiment, a decompression process is not required. During a fourth time $T_4$, the processing chamber 108 can be cycled through a plurality of decompression and compression cycles. The pressure can be cycled between a first pressure $P_3$ and a second pressure $P_4$ one or more times. In alternate embodiments, the first pressure $P_3$ and a second pressure $P_4$ can vary. In one embodiment, the pressure can be lowered by venting through the exhaust control system 160. For example, this can be accomplished by lowering the pressure to below approximately 1,500 psi and raising the pressure to above approximately 2,500 psi. The pressure can be increased by adding high-pressure carbon dioxide.

During a fifth time $T_5$, the processing chamber 108 can be returned to lower pressure. For example, after the decompression and compression cycles are complete, then the processing chamber can be vented or exhausted to atmospheric pressure. For substrate processing, the chamber pressure can be made substantially equal to the pressure inside of a transfer chamber (not shown) coupled to the processing chamber. In one embodiment, the substrate can be moved from the processing chamber into the transfer chamber, and moved to a second process apparatus or module to continue processing.

The plot 200 is provided for exemplary purposes only. It will be understood by those skilled in the art that a supercritical processing step can have any number of different time/pressures or temperature profiles without departing from the scope of the invention. Further, any number of cleaning and rinse processing sequences with each step having any number of compression and decompression cycles are contemplated. In addition, as stated previously, concentrations of various chemicals and species within a supercritical processing solution can be readily tailored for the application at hand and altered at any time within a supercritical processing step.

Figure 3:
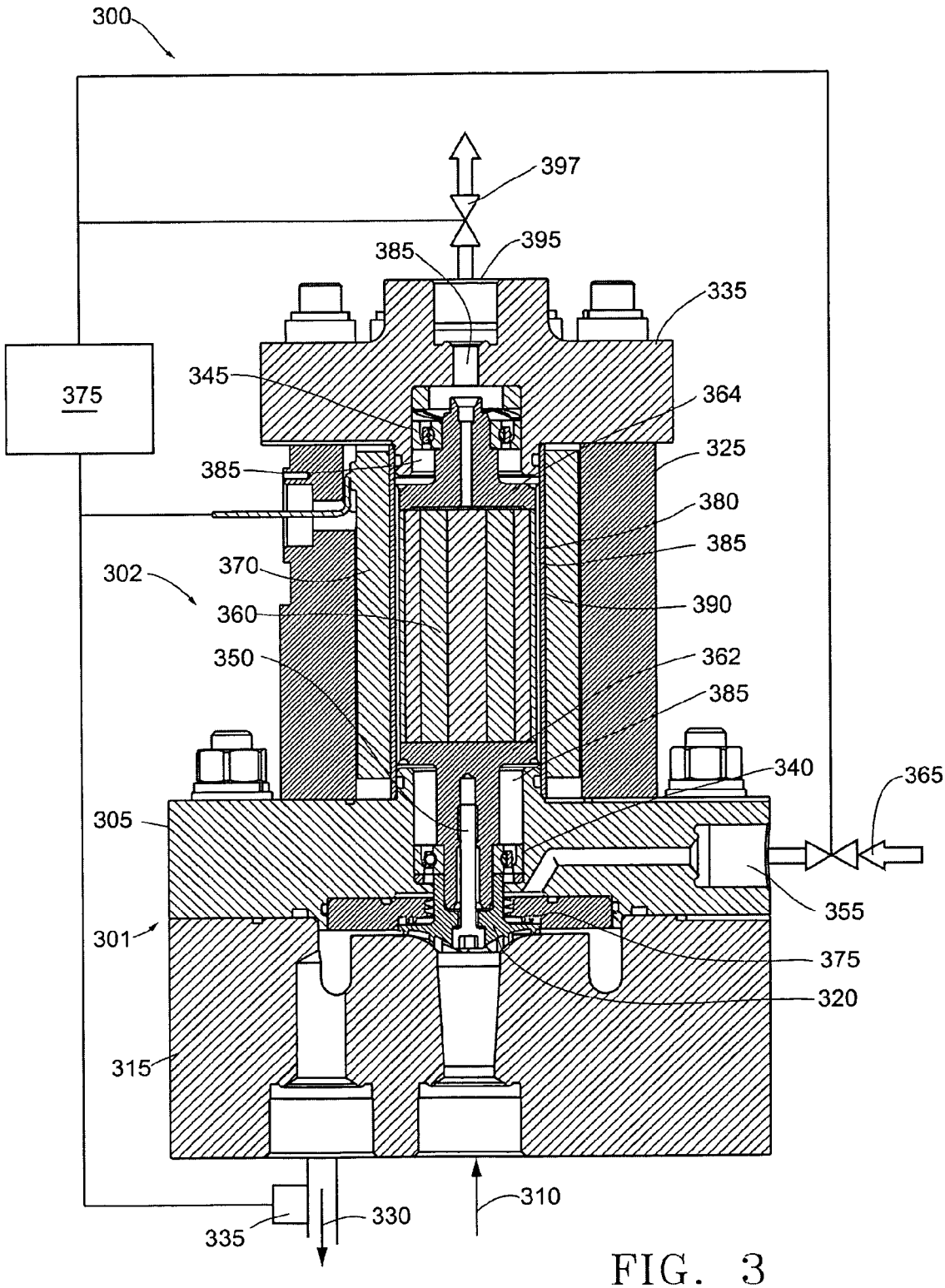
FIG. 3 illustrates a cross-sectional view of a pump assembly in accordance with an embodiment of the present invention.

FIG. 3 illustrates a cross-sectional view of a pump assembly in accordance with an embodiment of the present invention. The pump assembly can form a portion of the recirculation system 120 (FIG. 1). The pump assembly, which includes a pump section and a motor section, can have an operating pressure up to 5,000 psi. The pump assembly can have an operating temperature up to 250 degrees Celsius. The pump assembly can be used to pump a supercritical fluid that can include supercritical carbon dioxide or supercritical carbon dioxide admixed with an additive or solvent. A substantially pure coolant fluid can be flowed through the pump assembly and then recycled.

In the illustrated embodiment shown in FIG. 3, a brushless compact canned pump assembly 300 is shown having a pump section 301 and a motor section 302. The motor section 302 drives the pump section 301. The pump section 301 incorporates a centrifugal impeller 320 rotating within the pump section 301, which includes an inner pump housing 305 and an outer pump housing 315. A pump inlet 310 delivers pump fluid to the impeller 320, and the impeller 320 pumps the fluid to a pump outlet 330.

The motor section 302 includes a motor housing 325 and an outer motor assembly 335. The motor housing 325 can be coupled to the inner pump housing 305 and the outer motor assembly 335. A first set of bearings 340 can be located within the inner pump housing 305 and a second set of bearings 345 can be located within the outer motor assembly 335.

The bearings can be full ceramic ball bearings, hybrid ceramic ball bearings, full complement bearings, foil, journal bearings, hydrostatic bearings, or magnetic bearings. The bearings can operate without oil or grease lubrication. For example, the bearings can be made of silicon nitride balls combined with bearing races made of Cronidur®. Cronidur® is a corrosion resistant metal alloy from Barden Bearings.

The outer motor assembly 335 has a coolant outlet 395 through which a cooling fluid, such as substantially pure supercritical $CO_2$ can be vented. A regulator 397 can be located down stream of the coolant outlet 395 to control the venting of the cooling fluid. For example, the regulator 397 can comprise a valve and/or orifice. The regulator 397 can be coupled to the controller 375, and a flow through the regulator 397 can be controlled to stabilize the temperature of the motor 302. The outer motor assembly 335 can comprise one or more flow passages 385 coupled to the coolant outlet 395 and the second set of bearings 345.

The motor section 302 includes an electric motor having a stator 370 and a rotor 360 mounted within the motor housing 325. The electric motor can be a variable speed motor that is coupled to the controller 375 and provides for changing speed and/or load characteristics. Alternatively, the electric motor can be an induction motor. The rotor 360 is formed inside a non-magnetic stainless steel sleeve 380. A lower end cap 362 and an upper end cap 364 are coupled to the non-magnetic stainless steel sleeve 380. The lower end cap 362 can be coupled to the first set of bearings 340, and the upper end cap 364 can be coupled to the second set of bearings 345. The rotor 360 is canned to isolate it from contact with the cooling fluid. The rotor 360 preferably has a diameter between 1.5 inches and 2 inches.

The rotor 360 is also canned to isolate it from the fluid being pumped. A pump shaft 350 extends away from the motor section 302 to the pump section 301 where it is affixed to an end of the impeller 320. The pump shaft 350 can be coupled to the rotor 360 such that torque is transferred to the impeller 320. The impeller 320 can have a diameter that can vary between approximately 1 inch and approximately 2 inches, and impeller 320 can include rotating blades. This compact design makes the pump assembly 300 more lightweight, which also increases rotation speed of the electric motor.

The electric motor of the present invention can deliver more power from a smaller unit by rotating at higher speeds. The rotor 360 can have a maximum speed of 60,000 revolutions per minute (rpm). In alternate embodiments, different speeds and different impeller sizes may be used to achieve different flow rates. With brushless DC technology, the rotor 360 is actuated by electromagnetic fields that are generated by electric current flowing through windings of the stator 370. During operation, the pump shaft 350 transmits torque from the motor section 302 to the pump section 301 to pump the fluid.

The pump assembly 300 can include a controller 375 suitable for operating the pump assembly 300. The controller 375 can include a commutation controller (not shown) for sequentially firing or energizing the windings of the stator 370.

In one embodiment, the rotor 360 can be potted in epoxy and encased in the stainless steel sleeve 380 to isolate the rotor 360 from the fluid. Alternately, a different potting material may be used. The stainless steel sleeve 380 creates a high pressure and substantially hermetic seal. The stainless steel sleeve 380 has a high resistance to corrosion and maintains high strength at very high temperatures, which substantially eliminates the generation of particles. Chromium, nickel, titanium, and other elements can also be added to stainless steels in varying quantities to produce a range of stainless steel grades, each with different properties.

The stator 370 is also potted in epoxy and sealed from the fluid via a polymer sleeve 390. The polymer sleeve 390 is preferably a PEEK™ (Polyetheretherketone) sleeve. The PEEK™ sleeve forms a casing for the stator. Because the polymer sleeve 390 is an exceptionally strong highly crosslinked engineering thermoplastic, it resists chemical attack and permeation by $CO_2$ even at supercritical conditions and substantially eliminates the generation of particles. Further, the PEEK™ material has a low coefficient of friction and is inherently flame retardant. Other high-temperature and corrosion resistant materials, including alloys, can be used to seal the stator 370 from the cooling fluid.

A fluid passage 385 is provided between the stainless steel sleeve 380 of the rotor 360 and the polymer sleeve 390 of the stator 370. A cooling fluid flowing through the fluid passage 385 can provide cooling for the motor.

The lower end cap 362 can be coupled to the first set of bearings 340, and the upper end cap 364 can be coupled to the second set of bearings 345. The bearings 340 and 345 can also constructed to reduce particle generation. For example, wear particles generated by abrasive wear can be reduced by using ceramic (silicon nitride) hybrids. The savings in reduced maintenance costs can be significant.

In one embodiment, the bearing 340 and 345 are cooled with a cooling fluid such as substantially $CO_2$, and lubricants such as oil or grease are not used in the bearing cage in order to prevent contamination of the process and/or cooling fluid. In alternate embodiments, sealed bearings may be used that include lubricants.

A high pressure cooling fluid, such as substantially pure $CO_2$, can be injected into one or more flow passages 385 proximate the first set of pump bearings 340 through a coolant inlet 355. For example, the coolant inlet 355 can comprise a nozzle. A regulator 365 can be coupled to the coolant inlet 355 and can be used to control the pressure and/or flow of the injected cooling fluid. Controller 375 can be coupled to the regulator 365 for controlling pressure and/or flow. For example, a regulator capable of delivering the required flow rate while maintaining a constant delivery pressure may be used.

One or more flow passages 385 can be used to direct the cooling fluid to and around the first set of pump bearings 340, to direct the cooling fluid to and around the rotor 360, to direct the cooling fluid to and around the second set of pump bearings 345, and to direct the cooling fluid to and out the coolant outlet 395.

The operating pressure for the injected cooling fluid can be determined by the pressure of the supercritical process fluid exiting the pump outlet 330 when the process pressure is stabilized at a set pressure. For example, making the difference between the pressure of the injected cooling fluid and the pressure of the supercritical process fluid exiting the pump outlet 330 small can serve two purposes. First, it minimizes the leakage of the super critical process fluid from the pump 301 into the motor 302; this protects the sensitive pump bearings 340 and 345 from chemistry and particulates that are present in the supercritical process fluid. Second, it minimizes the leakage of the cooling fluid (substantially pure supercritical CO2) from the motor 302 to the pump 301 to prevent altering the supercritical process fluid. In alternate embodiments, the pressures can be different.

Because CO2 is a relatively poor lubricant, the cooling fluid provides a small amount of lubrication to the pump bearings 340 and 345. The cooling fluid is provided more for cooling the motor section 302 and the bearings 340 and 345 than for lubricating the bearings 340 and 345. As mentioned above, the bearings 340 and 345 are designed with materials that offer corrosion and wear resistance.

The cooling fluid can pass into the motor section 302 after having cooled the first set of bearings 340. Within the motor section 302, the cooling fluid flows through one or more flow passages 385 and cools the motor section 302, and the second set of bearings 345. In addition, the cooling fluid flows through one or more flow passages 385 in the outer motor assembly 335 and passes through a coolant outlet 395 in the outer motor assembly 335 and to a valve 397. The cooling fluid leaving the coolant outlet 395 may contain particles generated in the pump assembly 300. The cooling fluid can be passed through a filter and/or heat exchanger in the outer flow path (not shown) before being recycled.

In one embodiment, a filter can be coupled to the coolant inlet line 365 to reduce the contamination of the cooling fluid, such as substantially pure supercritical $CO_2$. For example, the filter may include a Mott point of use filter.

Actively reducing the pressure difference between the pressure of the process fluid and the cooling fluid serves to prevent leakage of the process fluid to the motor and the cooling fluid to the pump. In addition, a non-contact seal 375 can be used between the pump 301 and the motor 302 to further reduce leakage and mixing of the cooling fluid and the process fluid. To prevent the generation of particles, the seal can be a non-contact type. For example, a labyrinth seal can be used in which a series of knives is used to minimize the flow path and restrict the flow.

Figure 4:
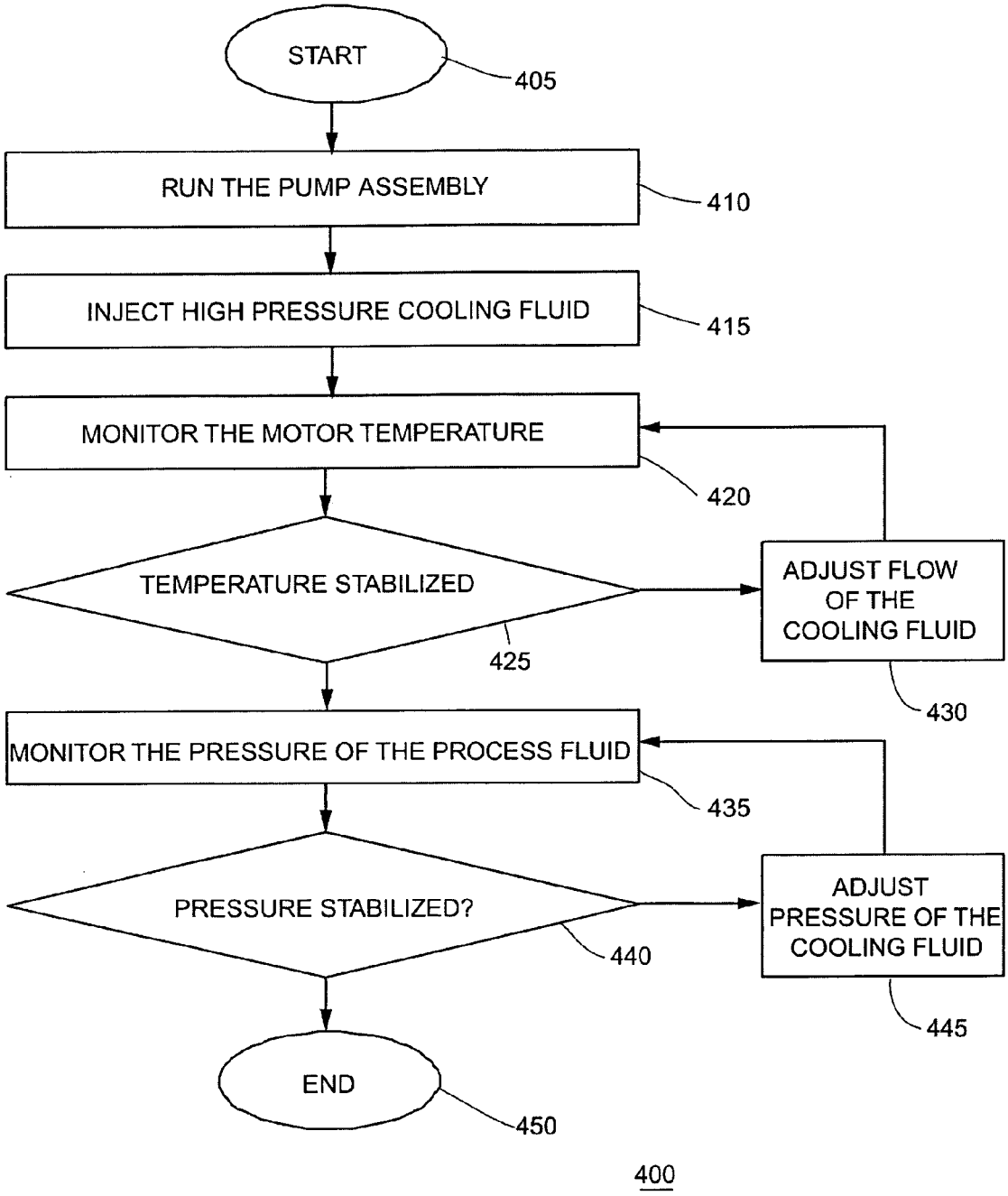
FIG. 4 shows a flow diagram for a method of operating a pump assembly in accordance with an embodiment of the invention.

FIG. 4 shows a flow diagram for a method of operating a pump assembly in accordance with an embodiment of the invention. In the illustrated embodiment, a procedure 400 is shown that includes steps for cooling the pump bearings in a pump assembly using a high pressure cooling fluid. Procedure 400 starts in 405.

In 410, the pump 301 and the motor 302 can be started. In 415, a high pressure cooling fluid can be injected into the pump portion 301 of the pump assembly. In one embodiment, the high pressure cooling fluid can be substantially pure supercritical $CO_2$. Alternately, the high pressure cooling fluid can be substantially pure high pressure liquid $CO_2$.

In one embodiment, the high pressure cooling fluid can be injected at the pump bearings 340 that support the pump shaft 350 and the high pressure cooling fluid lubricates and/or cools the pump bearings 340. Alternately, the high pressure cooling fluid can be injected at a plurality of locations around the pump bearings 340. In other embodiments, a high pressure cooling fluid may be injected at one or more locations around a second set of pump bearings 345.

In 420, the motor temperature can be monitored. In 425, a query can be performed to determine if the motor temperature has stabilized. When the temperature of the motor has stabilized, procedure 400 branches to step 435 and continues as shown in FIG. 4, and when the temperature of the motor has not stabilized, procedure 400 branches to step 430.

In 430, the flow of cooling fluid can be adjusted. For example, the valve or orifice aperture 397 controlling the coolant outlet 395 can be adjusted to change the flow rate of the cooling fluid.

In 435, the pressure of the process fluid in the processing chamber (108 FIG. 1) can be monitored. In an alternate embodiment, the pressure of the process fluid at the pump outlet can be monitored. In 440, a query can be performed to determine if a pressure difference is less than a desired value. For example, the coolant inlet pressure can be used to calculate the pressure difference. When the pressure difference is equal to or less than a desired value, procedure 400 branches to step 450 and ends as shown in FIG. 4, and when the pressure difference is not less than a desired value, procedure 400 branches to step 445. In one embodiment, the desired value can be approximately 100 psi. In alternate embodiments, the desired value can vary from approximately 3 psi. to approximately 10 psi.

In 445, the flow of cooling fluid can be adjusted. For example, the regulator and/or orifice 365 controlling the inlet pressure can be adjusted to reduce pressure differences. Alternately, the regulator and/or orifice 397 can be adjusted to reduce pressure differences. The flow of the pressurized coolant fluid through the pump assembly can be regulated based on a difference between the pressure of the supercritical process fluid in a process chamber coupled to the pump assembly and the pressure of the pressurized coolant fluid at the coolant outlet. In an alternate embodiment, the flow of the pressurized coolant fluid through the pump assembly can be regulated based on a difference between the pressure of the supercritical process fluid at the pump outlet and the pressure of the pressurized coolant fluid at the coolant outlet. In other embodiments, the pressure at the coolant inlet and/or outlet can be measured and used. Alternately, the pressure at the pump inlet and/or outlet can be measured and used.

While the invention has been described in terms of specific embodiments incorporating details to facilitate the understanding of the principles of construction and operation of the invention, such reference herein to specific embodiments and details thereof is not intended to limit the scope of the claims appended hereto. It will be apparent to those skilled in the art that modifications may be made in the embodiments chosen for illustration without departing from the spirit and scope of the invention.

What is claimed is:

1. A pump assembly for circulating a supercritical fluid comprising:

a) an impeller for pumping supercritical process fluid between a pump inlet and a pump outlet;

b) a rotatable pump shaft coupled to the impeller;

c) a motor coupled to the rotatable pump shaft, wherein the pump assembly comprises a plurality of bearings coupled to the rotatable pump shaft;

d) a plurality of flow passages coupled to the plurality of bearings; an injection means for delivering pressurized cooling fluid to the plurality of flow passages;

e) a regulator, coupled to the injection means, for controlling the pressure of the pressurized cooling fluid;

f) a coolant outlet for venting the pressurized cooling fluid from the pump assembly;

g) means for measuring a first pressure coupled to the pump outlet;

h) means for measuring a second pressure coupled to coolant outlet; and i) means for making a difference between the first pressure and the second pressure less than approximately 100 psi.

2. The pump assembly as claimed in claim 1, further comprising a controller coupled to the regulator, the means for measuring a first pressure, and the means for measuring a second pressure, the controller including means for adjusting the regulator to cause the difference between the first pressure and the second pressure less than approximately 10 psi.

3. The pump assembly as claimed in claim 1, further comprising a filter coupled to the coolant outlet.

4. The pump assembly as claimed in claim 1, further comprising a filter coupled to the regulator.

5. A pump assembly for circulating a supercritical fluid comprising:

a) an impeller for pumping supercritical process fluid between a pump inlet and a pump outlet;

b) a rotatable pump shaft coupled to the impeller;

c) a motor coupled to the rotatable pump shaft, wherein the pump assembly comprises a plurality of bearings coupled to the rotatable pump shaft;

d) a plurality of flow passages coupled to the plurality of bearings; an injection means for delivering pressurized cooling fluid to the plurality of flow passages;

e) a regulator, coupled to the injection means, for controlling the pressure of the pressurized cooling fluid;

f) a coolant outlet for venting the pressurized cooling fluid from the pump assembly;

g) means for measuring a first pressure in a process chamber coupled to the pump assembly;

h) means for measuring a second pressure coupled to the coolant outlet; and i) means for making a difference between the first pressure and the second pressure less than 100 psi.

6. A pump assembly for circulating a supercritical fluid comprising:

a) an impeller for pumping supercritical process fluid between a pump inlet and a pump outlet;

b) a rotatable pump shaft coupled to the impeller;

c) a motor coupled to the rotatable pump shaft, wherein the pump assembly comprises a plurality of bearings coupled to the rotatable pump shaft;

d) a plurality of flow passages coupled to the plurality of bearings; an injection means for delivering pressurized cooling fluid to the plurality of flow passages;

e) a regulator, coupled to the injection means, for controlling the pressure of the pressurized cooling fluid;

f) a coolant outlet for venting the pressurized cooling fluid from the pump assembly;

g) means for measuring a first pressure coupled to pump chamber coupled to the pump assembly;

h) means for measuring a second pressure coupled to the coolant outlet;

i) means for making a difference between the first pressure and the second pressure less than approximately 100 psi.

j) a controller coupled to the regulator, the means for measuring a first pressure, and the means for measuring a second pressure, the controller including means for adjusting the regulator to cause the difference between the first pressure and the second pressure to be less than 100 psi.

7. The pump assembly as claimed in claim 6, further comprising h) a seal centered around the rotatable pump shaft between the pump and the motor to minimize leakage of the supercritical process fluid and the cooling fluid between the pump and the motor.

8. The pump assembly as claimed in claim 6, wherein the seal is a non-contact seal.

9. The pump assembly as claimed in claim 7, wherein the seal is a labyrinth seal.

10. A pump assembly for circulating a supercritical fluid comprising:

a) an impeller for pumping supercritical process fluid between a pump inlet and a pump outlet;

b) a rotatable pump shaft coupled to the impeller;

c) a motor coupled to the rotatable pump shaft, wherein the pump assembly comprises a plurality of bearings coupled to the rotatable pump shaft;

d) a plurality of flow passages coupled to the plurality of bearings; an injection means for delivering pressurized cooling fluid to the plurality of flow passages;

e) a regulator, coupled to the injection means, for controlling the pressure of the pressurized cooling fluid; and f) a coolant outlet for venting the pressurized cooling fluid from the pump assembly, wherein the pressurized cooling fluid comprises substantially pure CO2.

11. A pump assembly for circulating a supercritical fluid comprising:

a) an impeller for pumping supercritical process fluid between a pump inlet and a pump outlet;

b) a rotatable pump shaft coup led to the impeller;

c) a motor coupled to the rotatable pump shaft, wherein the pump assembly comprises a plurality of bearings coupled to the rotatable pump shaft;

d) a plurality of flow passages coupled to the plurality of bearings; an injection means for delivering pressurized cooling fluid to the plurality of flow passages;

e) a regulator, coupled to the injection means, for controlling the pressure of the pressurized cooling fluid;

f) a coolant outlet for venting the pressurized cooling fluid from the pump assembly; and g) a valve coupled to the coolant outlet.

12. A method of cooling pump bearings in a pump assembly for circulating a supercritical fluid, the method comprising:

a) injecting pressurized substantially pure supercritical CO2 to the pump bearings; and b) regulating the flow of the pressurized substantially pure supercritical CO2 to make the difference between a pressure of the pressurized substantially pure supercritical CO2 and a pressure of the supercritical fluid in a pump outlet in n the pump assembly less than approximately 100 psi.

13. A method of cooling pump bearings in a pump assembly for circulating a supercritical fluid, the method comprising:

a) monitoring a temperature of a motor in the pump assembly, wherein the pump assembly comprises a pump and a motor connected by a rotatable pump shaft, and further wherein the pump has an impeller for pumping supercritical fluid between a pump inlet and a pump outlet;

b) flowing a pressurized coolant fluid through the pump assembly until the temperature of the motor is stabilized, wherein the pressurized coolant fluid flows from a coolant inlet through a plurality of coolant passages to a coolant outlet;

c) pumping supercritical process fluid from a pump inlet to a pump outlet;

d) monitoring a pressure of the supercritical process fluid at the pump outlet;

e) monitoring a pressure of the pressurized coolant fluid at the coolant outlet; and f) regulating the flow of the pressurized coolant fluid through the pump assembly based on a difference between the pressure of the supercritical process fluid at the pump outlet and the pressure of the pressurized coolant fluid at the coolant outlet, wherein the coolant fluid comprises substantially pure CO2.

14. The method of cooling pump bearings in a pump assembly for circulating a supercritical fluid as claimed in claim 13, the method further comprising:

g) causing the difference to be less than approximately 100 psi.

15. The method of cooling pump bearings in a pump assembly for circulating a supercritical fluid as claimed in claim 13, the method further comprising:

g) causing the difference to be less than approximately 10 psi.

16. The method of cooling pump bearings in a pump assembly for circulating a supercritical fluid as claimed in claim 13, the method further comprising:

g) regulating the flow of the pressurized coolant fluid through the pump assembly based on a difference between the pressure of the supercritical process fluid in a process chamber coupled to the pump assembly and the pressure of the pressurized coolant fluid at the coolant outlet, wherein the coolant fluid comprises substantially pure CO2.

17. The method of cooling pump bearings in a pump assembly for circulating a supercritical fluid as claimed in claim 16, the method further comprising:

h) causing the difference to be less than approximately 100 psi.

18. The method of cooling pump bearings in a pump assembly for circulating a supercritical fluid as claimed in claim 17, the method further comprising:

i) causing the difference to be less than approximately 10 psi.

19. A system for cooling pump bearings in a pump assembly for circulating a supercritical fluid, the system comprising:

a) means for monitoring a temperature of a motor in the pump assembly, wherein the pump assembly comprises a pump and a motor connected by a rotatable pump shaft, and further wherein the pump has an impeller for pumping supercritical fluid between a pump inlet and a pump outlet;

b) means for flowing a pressurized coolant fluid through the pump assembly until the temperature of the motor is stabilized, wherein the pressurized coolant fluid flows from a coolant inlet through a plurality of coolant passages to a coolant outlet;

c) means for pumping supercritical process fluid from a pump inlet to a pump outlet;

d) means for monitoring a pressure of the supercritical process fluid at the pump outlet;

e) means for monitoring a pressure of the pressurized coolant fluid at the coolant outlet; and f) means for regulating the flow of the pressurized coolant fluid through the pump assembly based on a difference between the pressure of the supercritical process fluid at the pump outlet and the pressure of the pressurized coolant fluid at the coolant outlet, wherein the coolant fluid comprises substantially pure CO2.

20. The system for cooling pump bearings in a pump assembly for circulating a supercritical fluid as claimed in claim 19, the system comprising:

g) means for regulating the flow of the pressurized coolant fluid through the pump assembly based on a difference between the pressure of the supercritical process fluid in a process chamber coupled to the pump assembly and the pressure of the pressurized coolant fluid at the coolant outlet, wherein the coolant fluid comprises substantially pure CO2.

* * * * *

UNITED STATES PATENT AND TRADEMARK OFFICE

CERTIFICATE OF CORRECTION

PATENT NO. : 7,186,093 B2
APPLICATION NO. : 10/959483
DATED : March 6, 2007
INVENTOR(S) : Gentaro Goshi It is certified that error appears in the above-identified patent and that said Letters Patent is hereby corrected as shown below:

On Title Page, Item -56-

IN THE REFERENCES CITED - FOREIGN PATENT DOCUMENTS - p. 3

Replace "JP 2001/106358 4/1998" with -- JP 2000/106358 4/2000--

In column 11, line 1-2, replace "coolant inlet line 365" with -- coolant inlet 355--.

In column 13, line 30, claim 6, section i), replace "psi." with --psi; and--
In column 14, line 22, claim 12, section b), delete "n" between "in" and "the".

Signed and Sealed this

First Day of May, 2007

JON W. DUDAS
*Director of the United States Patent and Trademark Office*